US008599094B2

(12) United States Patent
Lee

(10) Patent No.: US 8,599,094 B2
(45) Date of Patent: Dec. 3, 2013

(54) LOOP ANTENNA

(75) Inventor: Jong-hyuck Lee, Seongnam-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 355 days.

(21) Appl. No.: 13/012,383

(22) Filed: Jan. 24, 2011

(65) Prior Publication Data

US 2011/0291912 A1 Dec. 1, 2011

(30) Foreign Application Priority Data

May 28, 2010 (KR) ..... 10-2010-0050170

(51) Int. Cl.
*H01Q 21/00* (2006.01)

(52) U.S. Cl.
USPC ..... 343/867; 343/866

(58) Field of Classification Search
USPC ..... 343/860, 861, 866, 867, 741, 742
See application file for complete search history.

(56) References Cited

U.S. PATENT DOCUMENTS 5,248,989 A * 9/1993 Murdoch ..... 343/841
5,508,710 A 4/1996 Wang et al.
5,914,692 A * 6/1999 Bowers et al. ..... 343/742
6,025,813 A * 2/2000 Hately et al. ..... 343/867
6,597,318 B1 7/2003 Parsche et al.
6,861,992 B2 * 3/2005 Kawakami et al. ..... 343/741

FOREIGN PATENT DOCUMENTS

EP 0739050 A1 10/1996
EP 0766200 A2 4/1997
EP 1494311 A1 1/2005

OTHER PUBLICATIONS

Communication dated Sep. 12, 2011 issued by the European Patent Office in counterpart European Application No. 11166800.0.

* cited by examiner

*Primary Examiner* — Hoanganh Le
(74) *Attorney, Agent, or Firm* — Sughrue Mion, PLLC

(57) ABSTRACT

A loop antenna is provided. The loop antenna includes: a substrate; an outer pattern including at least one loop on a surface of the substrate; and an inner pattern in an inner region of the at least one loop of the outer pattern, an end of the inner pattern being connected to an end of the outer pattern, wherein the inner pattern is configured so that an electric current flows in the inner pattern in a direction opposite to a direction in which the electric current flows in the outer pattern. Accordingly, an H-Field characteristic of the loop antenna can be enhanced, thereby allowing the loop antenna to have a decreased size and an improved performance.

18 Claims, 6 Drawing Sheets

G PATTERN LOOP ANTENNA H-FIELD PERFORMANCE

LOOP ANTENNA

CROSS-REFERENCE TO RELATED APPLICATION

This application claims priority from Korean Patent Application No. 10-2010-0050170, filed on May 28, 2010 in the Korean Intellectual Property Office, the disclosure of which is incorporated herein by reference in its entirety.

BACKGROUND

1. Field

Apparatuses and methods consistent with exemplary embodiments relate to a loop antenna. More specifically, apparatuses and methods consistent with exemplary embodiments relate to a loop antenna in which an inner pattern is formed in an inner region of an outer pattern having a loop form.

2. Description of the Related Art

In recent times, short-range wireless communication technologies have been variously implemented. Particularly, if a communication using radio-frequency identification (RFID), which is an example of the short-range wireless communication, is utilized, convenience of users can be improved in various fields, such as a material management, a transportation card, a purchase, etc.

The RFID communication uses an antenna for RFID. For example, a loop antenna may be used as the antenna for RFID. Moreover, a greater size of the loop antenna results in an improved radiation performance. Accordingly, loop antennas have become larger in size.

According to the structural characteristics as described above, an inner region of the loop antenna has been acknowledged as an unusable region. However, recently, as various mobile appliances become lighter and smaller, there is a need for the loop antenna to reduce in size and, at the same time, to improve in performance.

SUMMARY

Exemplary embodiments overcome the above disadvantages and other disadvantages not described above. Also, an exemplary embodiment is not required to overcome the disadvantages described above, and an exemplary embodiment may not overcome any of the problems described above.

Exemplary embodiments provide a loop antenna in which an inner pattern is formed in an inner region of an outer pattern, so that an electric current flows in a direction opposite to a direction in which the electric current flows in the outer pattern.

According to an aspect of an exemplary embodiment, there is provided a loop antenna including: a substrate; an outer pattern including at least one loop on a surface of the substrate; and an inner pattern in an inner region of the at least one loop of the outer pattern, an end of the inner pattern being connected to an end of the outer pattern, wherein the inner pattern is configured so that an electric current flows in a direction in the inner pattern opposite to a direction in which the electric current flows in the outer pattern.

The inner pattern may be a linear bar form having a plurality of inflection points.

The plurality of inflection points may be seven inflection points.

The inner pattern may be a spiral form.

The outer pattern may include a plurality of loops in the form of a square, and each of the plurality of loops may have chamfered corners.

The outer pattern may be configured so that a first end and a second end of an innermost loop of the plurality of loops are projected and extended into the inner region.

Portions of the innermost loop projected and extended to the first end and the second end thereof are parallel to each other.

The inner pattern may include a first region having a form corresponding to a form of the outer pattern, and a second region connected with the first region and projected and extended toward a center of the inner region.

The first region may be disposed in parallel and in a predetermined spaced-apart relation with respect to the outer pattern.

The first region may include two chamfered corners.

The loop antenna may further include a power supplying part to apply an electric power to another end of the outer pattern.

The inner pattern may be a "G" form.

The loop antenna may be operated at a frequency of 13.56 MHz.

According to an aspect of another exemplary embodiment, there is provided a radio-frequency identification (RFID) short-range wireless communication device including: a loop antenna including: a substrate, an outer pattern comprising at least one loop on a surface of the substrate, and an inner pattern in an inner region of the at least one loop of the outer pattern, an end of the inner pattern being connected to an end of the outer pattern, wherein the inner pattern is configured so that an electric current flows in the inner pattern in a direction opposite to a direction in which the electric current flows in the outer pattern, and wherein the loop antenna is implemented for RFID communication.

BRIEF DESCRIPTION OF THE DRAWINGS

The above and/or other aspects will become more apparent by describing certain exemplary embodiments with reference to the accompanying drawings, in which.

DETAILED DESCRIPTION OF EXEMPLARY EMBODIMENTS

Figure 1:
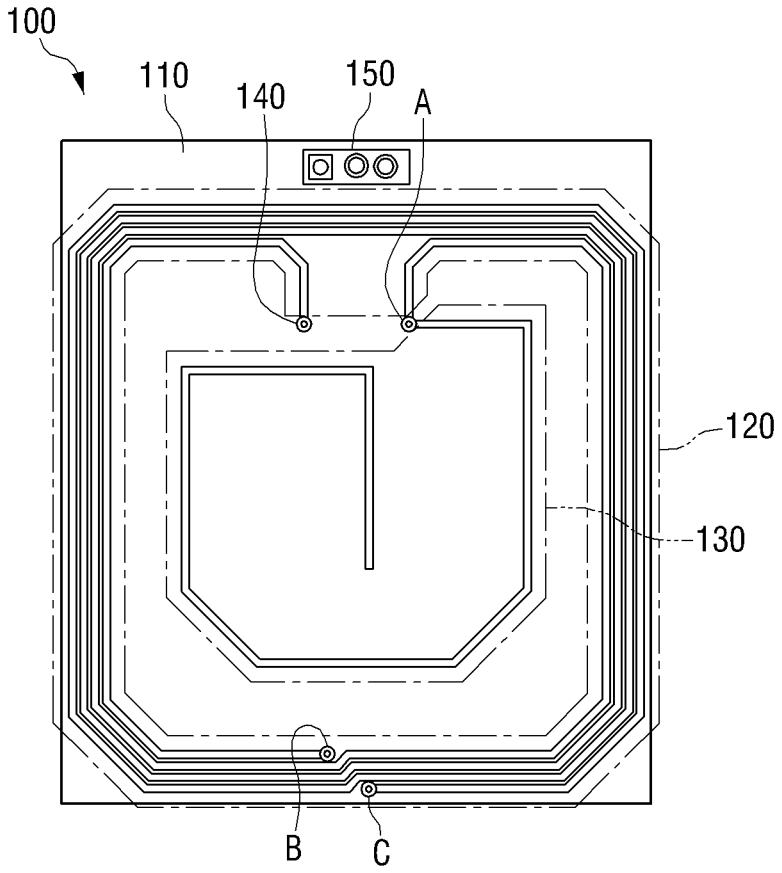
FIG. 1 is a view illustrating a loop antenna according to an exemplary embodiment.

Exemplary embodiments are described in greater detail below with reference to the accompanying drawings. In the following description, like drawing reference numerals are used for like elements, even in different drawings. The matters defined in the description, such as detailed constructions and elements, are provided to assist in a comprehensive understanding of exemplary embodiments. However, an exemplary embodiment can be practiced without those specifically defined matters. Also, well-known functions or constructions are not described in detail since they would obscure the exemplary embodiments with unnecessary detail.

FIG. 1 is a view illustrating a loop antenna according to an exemplary embodiment. Referring to FIG. 1, the loop antenna 100 includes a substrate 110, an outer pattern 120, an inner pattern 130, a power supplying part 140, and a matching part 150.

Conductor patterns are provided on an upper surface of the substrate 110, such as the outer pattern 120, the inner pattern 130, the power supplying part 140, and the matching part 150. The substrate 110 may be made of an insulating material, such as silicon.

The outer pattern 120 forms at least one loop on the upper surface of the substrate 110. The outer pattern 120 may be formed by etching the upper surface of the substrate 110, by printing with a conductive ink on the upper surface of the substrate 110, etc. Furthermore, the outer pattern 120 may include a conductive material, such as gold, silver, cooper, aluminum, stainless steel and an alloy thereof, silver-plated copper, tin-plated cooper, etc.

The at least one loop formed on the outer pattern 120 may include a plurality of loops disposed in a predetermined spaced-apart relation with respect to one another. Although the outer pattern 120 is illustrated as having four loops in FIG. 1, it is understood that another exemplary embodiment is not limited thereto, and any plural number of loops may be included in the outer pattern 120.

As the plurality of loops of the outer pattern 120 is formed on an edge of the substrate 110, an inner region may be defined in the center of the substrate 110. An inner pattern, to be described later, may be formed in inner region.

Also, although the outer pattern 120 is illustrated as having a square form in FIG. 1, it is understood that another exemplary embodiment is not limited thereto. For example, the outer pattern 120 according to another exemplary embodiment may have a circle form, an oval form, a polygon form, etc., according to a usage of the loop antenna 100.

The outer pattern 120 according to the present exemplary embodiment is in the form of a square, as described above, and has a form in which respective corners are chamfered. For example, the corners may be chamfered at an angle of approximately 45°.

A first end A of an innermost loop among the plurality of loops of the outer pattern 120 is connected with a first end of the inner pattern 130. The first end A and a second end of the innermost loop of the plurality of loops are projected and extended into the inner region from the edge of the substrate 110. Portions of the innermost loop projected and extended to the first end A and the second end thereof may be disposed parallel to each other.

Furthermore, an intermediate end B of the innermost loop among the plurality of loops is connected with an intermediate end C of an outermost loop through a back surface of the substrate.

The inner pattern 130 is disposed in the inner region of the loops formed by the outer pattern 120. The first end of the inner pattern 130 is connected with the first end A of the outer pattern 120. A second end of the inner pattern 130 is spaced apart from the outer pattern 120 and disposed in the inner region.

The inner pattern 130 may be formed with the same or similar method and of the same or similar material as the outer pattern 120 described above.

It is understood that the inner pattern 130 may have any form in which the inner pattern 130 is connected to the outer pattern 120 at the first end thereof and spaced apart from the outer pattern 120 at the second end thereof.

For example, the inner pattern 130 may be a spiral form, a "G" form, or a left and right-rotated "G" form, as illustrated in FIG. 1. However, as described above, it is understood that the inner pattern is not limited to the form illustrated in FIG. 1 according to another exemplary embodiment.

The inner pattern 130 is configured so that an electric current flows in a direction opposite to a direction in which the electric current flows in the outer pattern 120. Also, the inner pattern 130 may have the same or similar form as that of the outer pattern 120. For example, if the outer pattern 120 is in the form of a square, the inner pattern 130 may also be in the form of the square. Similarly, if the outer pattern 120 is in the form of a circle, the inner pattern 130 may also be in the form of the circle. That is, the inner pattern 130 may have a structure corresponding to the outer pattern 120 on the whole or in part.

A signal, such as a wireless frequency signal or a high frequency signal, may be supplied to the power supplying part 140. The power supplying part 140 may also include a coil or the like, and be disposed on one region of the upper surface or the back surface of the substrate 110 to charge the supplied electric signal by radio (not shown)

The matching part 150 varies an inductance component and a capacitance component to perform an impedance matching. For example, the matching part 150 may perform the impedance matching to allow the loop antenna 100 to operate at a resonance frequency of 13.56 MHz.

Furthermore, the loop antenna 100 may be utilized in a radio-frequency identification (RFID) short-range wireless communication that operates at a resonance frequency of 13.56 MHz. Accordingly, the loop antenna 100 having a high performance may be provided for various applications, such as an E-book, an RFID tag, etc.

Figure 2:
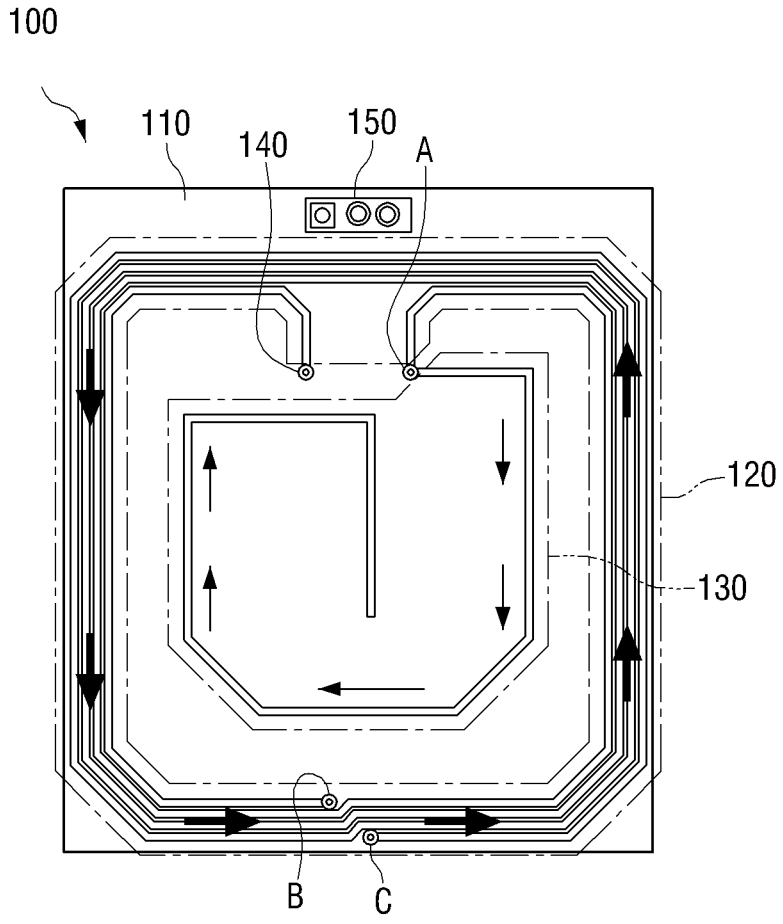
FIG. 2 is a view illustrating an operating principle of a loop antenna according to an exemplary embodiment.

FIG. 2 is a view illustrating an operating principle of a loop antenna 100 according to an exemplary embodiment. Referring to FIG. 2, the signal inputted through the power supplying part 140 produces an electric field while spinning along the plurality of loops of the outer pattern 120.

In the outer pattern 120, an electric current may flow in a direction of an arrow shown in FIG. 2, that is, a counterclockwise direction. Conversely, in the inner pattern 130, an electric current may flow in a direction of an arrow shown in FIG. 2, that is, a clockwise direction.

As described above, the loop antenna 100 is configured so that the direction of the electric current in the outer pattern 120 is opposite to that in the inner pattern 130, and enables the outer pattern 120 and the inner pattern 130 to be disposed in parallel and in a predetermined spaced-apart relation with respect to each other. Thus, a parasitic capacitance (or, a parasitic inductance) can occur due to the inner pattern 130, the outer pattern 120 and the substrate 110 between the inner pattern 130 and the outer pattern 120, thereby allowing the loop antenna 100 to achieve improvements in resonance characteristics and performance.

Figure 3:
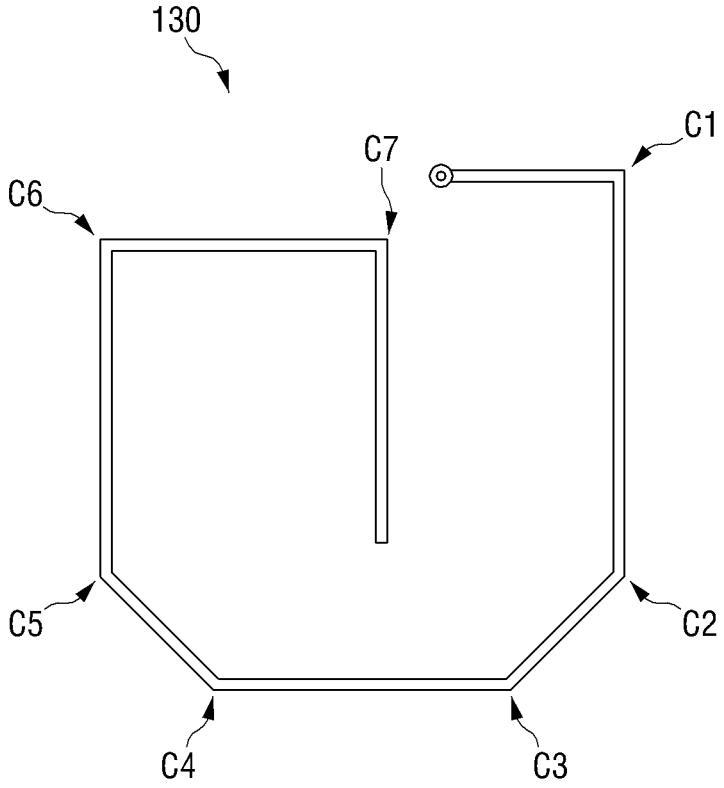
FIGS. 3 and 4 are views illustrating an example of an inner pattern of a loop antenna according to an exemplary embodiment.
Figure 4:
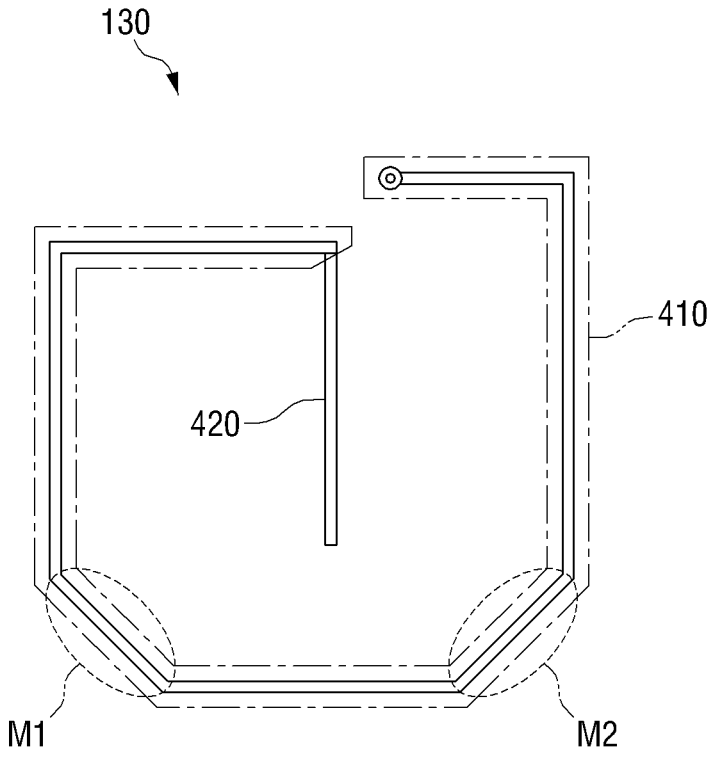

FIGS. 3 and 4 are views illustrating an example of an inner pattern 130 according to an exemplary embodiment. Referring to FIG. 3, the inner pattern 130 may be a bar form having a plurality of inflection points (or inflection portions) C1-C7. Here, the inflection points are bend points where the linear bar is bent.

In the exemplary embodiment illustrated in FIG. 3, the plurality of inflection points C1-C7 includes a first inflection point C1, a second inflection point C2, a third inflection point C3, a fourth inflection point C4, a fifth inflection point C5, a sixth inflection point C6, and a seventh inflection point C7.

Although the inner pattern 130 is illustrated as including two corners having a chamfered form in FIG. 3, it is understood that another exemplary embodiment is not limited thereto. For example, according to another exemplary embodiment, the inner pattern 130 may include five inflection points without the two chamfered forms.

Referring to FIG. 4, the inner pattern 130 includes a first region 410 and a second region 420. The first region 410 has a form corresponding to the outer pattern 120 and, at one end thereof, is connected with one end of the second region. The first region 410 may be disposed in parallel and in a predetermined spaced-apart relation with respect to the outer pattern 120. The first region 410 may include two corners having a chamfered form.

The second region 420 does not correspond to the outer pattern 120, but is projected and extended toward a center of the inner region.

Though not limited thereto, the loop antenna 100 may be approximately 4 cm wide and approximately 4 cm long, and may have a space between the inner pattern 120 (more particularly, the first region 410) and the outer pattern 120 in the range of approximately 3 to 5 mm.

Figure 5:
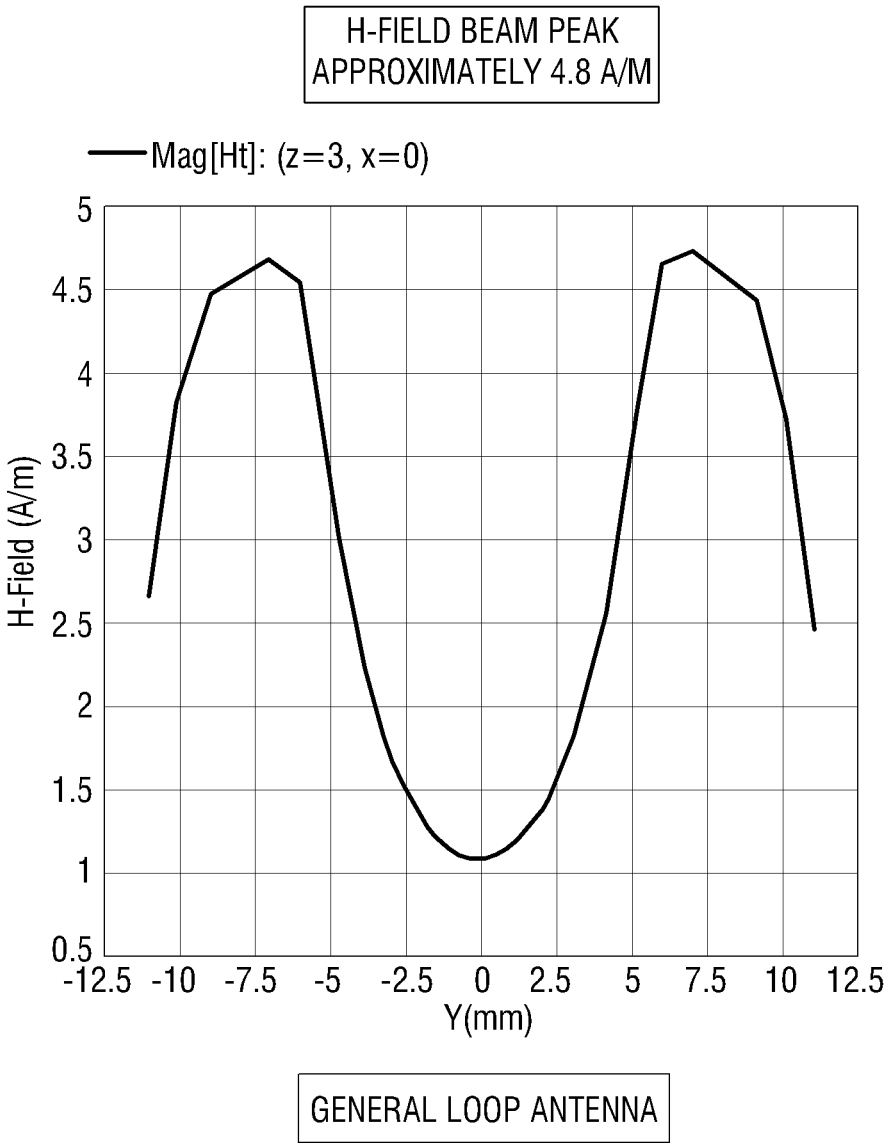
FIG. 5 is a graph illustrating an operating characteristic of a loop antenna.
Figure 6:
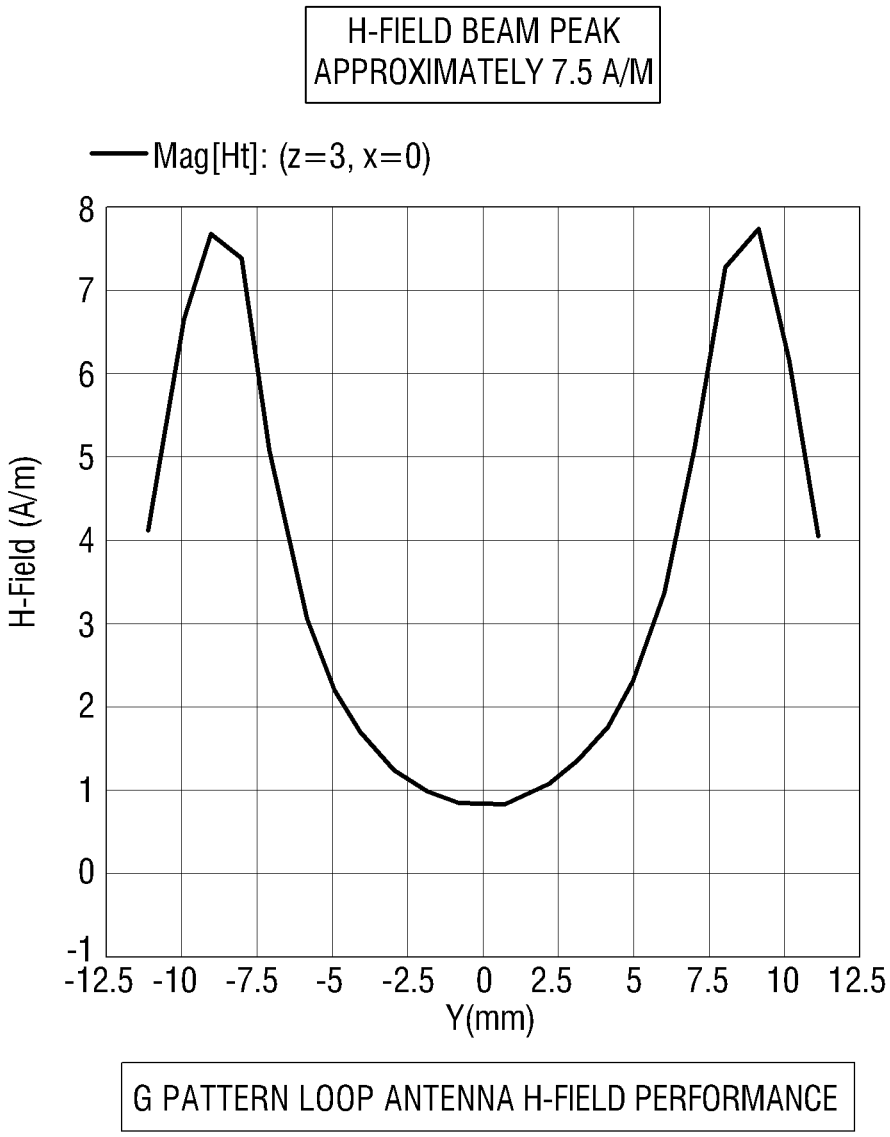
FIG. 6 is a graph illustrating an operating characteristic of a loop antenna according to an exemplary embodiment.

FIG. 5 is a graph illustrating an operating characteristic of a loop antenna, and FIG. 6 is a graph illustrating an operating characteristic of a loop antenna according to an exemplary embodiment. Since the operating characteristic of the loop antenna is influenced more by a magnetic field than an electric field, an H-Field characteristic is explained as follows with reference to FIGS. 5 and 6.

Referring to FIG. 5, it can be appreciated that in the general loop antenna, a beam peak value of the H-Field is approximately 4.8 A/m, whereas in the loop antenna according to an exemplary embodiment, the beam peak value of the H-Field is approximately 7.5 A/m.

Since the inner pattern 130 in which the electric current flows in the direction opposite to that in the outer pattern 120 is formed in the inner region of the loop antenna 100 as described above, an energy radiated from the inner region is moved in an edge direction, thereby allowing the beam peak value of the H-Field to greatly improve.

In addition, a bandwidth is also increased in the same value of the H-Field, for example, 3 A/m. That is, since the beam peak value of the H-Field is greatly improved and the bandwidth is increased, the operating characteristic of the loop antenna is improved. Thus, the loop antenna has an improved performance in a same antenna volume (size) as compared to a related art antenna.

The foregoing exemplary embodiments and advantages are merely exemplary and are not to be construed as limiting the present inventive concept. The present teaching can be readily applied to other types of apparatuses. Also, the description of the exemplary embodiments is intended to be illustrative, and not to limit the scope of the claims, and many alternatives, modifications, and variations will be apparent to those skilled in the art.

What is claimed is:

1. A loop antenna comprising:

a substrate;

an outer pattern comprising at least one loop on a surface of the substrate; and an inner pattern in an inner region of the at least one loop of the outer pattern, an end of the inner pattern being connected to an end of the outer pattern, wherein the inner pattern is configured so that an electric current flows in the inner pattern in a direction opposite to a direction in which the electric current flows in the outer pattern, and wherein the outer pattern is configured so that a first end and a second end of an innermost loop of the outer pattern are projected and extended into the inner region.

2. The loop antenna of claim 1, wherein the inner pattern comprises a linear bar form having a plurality of inflection points.

3. The loop antenna of claim 2, wherein the linear bar form has a total of seven inflection points.

4. The loop antenna of claim 1, wherein the inner pattern comprises a spiral form.

5. The loop antenna of claim 1, wherein the outer pattern comprises a plurality of loops.

6. The loop antenna of claim 5, wherein the outer pattern is configured so that a first end and a second end of an innermost loop of the plurality of loops are projected and extended into the inner region.

7. The loop antenna of claim 1, wherein portions of the innermost loop projected and extended to the first end and the second end of the innermost loop are parallel to each other.

8. A loop antenna comprising:

a substrate;

an outer pattern comprising at least one loop on a surface of the substrate; and an inner pattern in an inner region of the at least one loop of the outer pattern, an end of the inner pattern being connected to an end of the outer pattern, wherein the inner pattern is configured so that an electric current flows in the inner pattern in a direction opposite to a direction in which the electric current flows in the outer pattern, wherein the outer pattern comprises a plurality of loops, and wherein the inner pattern comprises a first region having a form corresponding to a form of the outer pattern, and a second region connected with the first region and projected and extended toward a center of the inner region.

9. The loop antenna of claim 8, wherein the first region is disposed in parallel and in a predetermined spaced-apart relation with respect to the outer pattern.

10. The loop antenna of claim 8, wherein the first region comprises two chamfered corners.

11. The loop antenna of claim 1, further comprising a power supplying part which applies an electric power to another end of the outer pattern.

12. The loop antenna of claim 1, wherein the inner pattern has a "G" form.

13. The loop antenna of claim 1, wherein the loop antenna is operated at a frequency of 13.56 MHz.

14. The loop antenna of claim 1, wherein:

the outer pattern comprises a plurality of loops in a square form; and each of the plurality of loops has chamfered corners.

15. The loop antenna of claim 1, wherein a space between the inner pattern and the outer pattern is in a range of 3 mm to 5 mm.

16. The loop antenna of claim 1, further comprising a matching part which varies an inductance component and a capacitance component to perform an impedance matching.

17. The loop antenna of claim 1, wherein the inner pattern has a same form as that of the outer pattern.

18. A radio-frequency identification (RFID) short-range wireless communication device comprising:

a loop antenna comprising:

a substrate, an outer pattern comprising at least one loop on a surface of the substrate, and an inner pattern in an inner region of the at least one loop of the outer pattern, an end of the inner pattern being connected to an end of the outer pattern, wherein the inner pattern is configured so that an electric current flows in the inner pattern in a direction opposite to a direction in which the electric current flows in the outer pattern, wherein the loop antenna is implemented for RFID communication, and wherein the outer pattern is configured so that a first end and a second end of an innermost loop of the outer pattern are projected and extended into the inner region.

* * * * *